US005734223A

United States Patent [19]

Makishima et al.

[11] Patent Number: 5,734,223

[45] Date of Patent: Mar. 31, 1998

[54] FIELD EMISSION COLD CATHODE HAVING MICRO ELECTRODES OF DIFFERENT ELECTRON EMISSION CHARACTERISTICS

[75] Inventors: Hideo Makishima, Tokyo; Yoshiaki Yanai, Shiga, both of Japan

[73] Assignee: NEC Corporation, Tokyo, Japan

[21] Appl. No.: 564,811

[22] Filed: Nov. 29, 1995

[30] Foreign Application Priority Data

Nov. 29, 1994 [JP] Japan ..... 6-294390

[51] Int. Cl.[6] ..... H01J 1/30

[52] U.S. Cl. ..... 313/495; 313/309; 313/336; 313/351; 313/496

[58] Field of Search ..... 313/309, 336, 313/351, 495, 496, 497

[56] References Cited

U.S. PATENT DOCUMENTS 5,278,472 1/1994 Smith et al. ..... 313/309

FOREIGN PATENT DOCUMENTS 64-54637 3/1989 Japan .
6-12974 1/1994 Japan .
6-84453 3/1994 Japan .
6-111737 4/1994 Japan .

OTHER PUBLICATIONS

"A Thin-Film Field-Emission Cathode," Spindt, C.A., *J. Applied Physics*, vol. 39, No. 7, Jun. 1968, 3504–3505.

*Primary Examiner*—Sandra L. O'Shea
*Assistant Examiner*—Jay M. Patidar
*Attorney, Agent, or Firm*—Sughrue, Mion, Zinn, Macpeak & Seas, PLLC

[57] ABSTRACT

In a field emission cold cathode composed of a plurality of micro cold cathodes, the diameter of a plurality of openings formed in a gate electrode is large at a central region of an electron emission zone but small at a peripheral region of the electron emission zone, or the thickness of the gate electrode is small at the central region of the electron emission zone but large at the peripheral region of the electron emission zone. Alternatively, the thickness of an insulator layer is small at the central region of the electron emission zone but large at the peripheral region of the electron emission zone. Or, a resistance layer is provided between a substrate and a plurality of electron emission electrodes, and resistivity of the resistance layer is small at the central region of the electron emission zone but large at the peripheral region of the electron emission zone.

21 Claims, 6 Drawing Sheets

FIELD EMISSION COLD CATHODE HAVING MICRO ELECTRODES OF DIFFERENT ELECTRON EMISSION CHARACTERISTICS

BACKGROUND OF THE INVENTION

1. Field of the Invention

The present invention relates to a cold cathode acting as an electron emission source, and more specifically to a field emission cold cathode configured to emit electrons from a sharp tip end of micro electrodes, and display devices using the same.

2. Description of Related Art

C. A. Spindt, "A Thin-Film Field-Emission Cathode", Journal of Applied Physics, Vol. 39, No. 7, pp 3504–3505, June 1968, the disclosure of which is incorporated by reference in its entirety into the present application, proposed a cold cathode having a number of micro cold cathodes which are located in the form of an array and each of which is formed of a micro conical emitter, and a gate electrode (extraction electrode) positioned separated from but near to the micro conical emitter for the purpose of causing electrons to be emitted from the micro conical emitter and also for the purpose of controlling the current of the electrons emitted from the micro conical emitters. This cold electrode proposed by Spindt is advantageous, since an obtained current density is remarkably larger than that of a hot cathode, and a dispersion in velocity of the electrons emitted is small. In addition, a current noise is smaller than that of a single field emission emitter. Furthermore, this Spindt type of field emission cold cathode can operate with a low voltage as low as 10 V to 200 V, and also can operate under a relatively bad vacuum atmosphere.

Referring to FIG. 1, there is shown a sectional view illustrating an essential part of the Spindt type cold cathode disclosed by the above referred document. In the shown structure, an insulator layer 102 and a gate electrode 103 are deposited on a substrate 101 in the named order, and a cavity 104 is formed in the stacked structure of the insulator layer 102 and the gate electrode 103. Within the cavity 104, a micro conical emitter 105 having a height of about 1 μm is formed by a film deposition process. The substrate 101 and the emitter 105 are electrically connected to each other, and a voltage of about 100 V is applied between the emitter 105 and the gate electrode 103. A thickness of the insulator layer 102 is about 1 μm, and an aperture diameter of the gate electrode is also about 1 μm. A tip end of the emitter 105 is as sharp as about 10 nm. Therefore, a strengthened electric field is applied on the tip end of the emitter 105. When this applied electric field becomes $2\times10^7$ V/cm to $5\times10^7$ V/cm or more, electrons will be emitted from the tip end of the emitter 105. By arranging a number of micro cold cathodes of this structure in an array form, a planar cathode capable of emitting a large current is constituted.

In the above mentioned field emission cold cathode, however, a travelling path of the electrons emitted from the tip end of the emitter of the micro cold cathode is not necessarily in parallel to a center axis of the emitter perpendicular to a plane of the substrate, and therefore, the emitted electrons have a lateral velocity component perpendicular to the center axis. This is because, as shown in FIG. 1, equipotential planes 106 in proximity of the emitter tip end, formed by the emitter 105 and the gate electrode 103, exerts an effect of a concave lens to the electrons, so that the travelling path of electrons is caused to diverge. According to a simulation, an outermost travelling path of electrons is inclined 30 degrees or more to the center axis of the emitter.

In a cathode ray tube, if electrons emitted from an cathode contain the lateral velocity component as mentioned above, an electron beam shaped by an electrostatic focusing system has an unnecessary spread. As a result, an electron beam spot having a high current density and a micro diameter cannot be formed on a screen of the cathode ray tube. Therefore, if the above mentioned cold cathode is assembled in the cathode ray tube, it becomes impossible to realize a satisfactorily high resolution of image.

In addition, if the above mentioned cold cathode is assembled in a flat display panel in which a phosphor surface and an electron source are opposed to each other in each one pixel in a narrow space, some part of electrons emitted from one cathode for one pixel bombards the phosphor for an adjacent pixel, with the result that both the resolution of image and the contrast drop. In particular, in a color flat display panel, the degree of color purity also drops.

For example, when the flat display panel is fabricated under such a condition that the voltage between the emitter and the gate electrode is 50 V, the voltage between a screen and the gate electrode is 200 V, and a distance between the screen and the gate electrode is 50 μm, the electrons emitted at an angle of 30 degrees inclined to the center axis come into collision with the screen at a position separated, by about 17 μm, from a position on an extension of the center axis of the emitter.

In order to overcome this disadvantage, it may be considered to enlarge the area of the phosphor for each one pixel in comparison with the area of the cathode for each one pixel, or alternatively, to shorten the distance between the cathode and the phosphor so that the electrons strike to the phosphor before the electrons become divergent, or further, to provide a barrier partition for physically preventing the electrons from reaching the adjacent pixel. However, these approaches will cause such another problem that the definition of the display panel is restricted or the structure of the display panel becomes complicated.

In order to solve the above mentioned problems, Japanese Patent Application Laid-open Publication No. JP-A-6-012974 has proposed a cold cathode structure as shown in FIG. 2, which includes a focusing electrode 112. In FIG. 2, elements similar to those shown in FIG. 1 are given the same Reference Numerals, and explanation thereof will be omitted for simplification of the description.

In the structure shown in FIG. 2, a second insulator layer 111 is deposited on the gate electrode 103, and a focusing electrode 112 is formed on the second insulator layer 111. By making a voltage applied between the emitter 105 and the focusing electrode 112 smaller than the voltage applied between the emitter 105 and the gate electrode 103, an electro-optical convex lens is formed in the proximity of the focusing electrode 112, so that the electrons emitted from the emitter 105 is subjected to a focusing action, whereby the divergence is suppressed to become small.

In this structure, since the focusing electrode 112 is located just above the gate electrode 103 through a relatively thin second insulator layer 111, the electric field strength of the emitter tip end is determined by the potential of the gate electrode 103 and the focusing electrode 112 On the other hand, as mentioned above, in order to create a focusing action of the electron beam, the voltage applied between the emitter and the focusing electrode is required to be smaller than the voltage applied between the emitter and the gate electrode. Therefore, in order to obtain the same emission current as that obtained in the structure shown in FIG. 1, a high gate voltage is required, resulting in a large voltage amplitude required to modulate the electron beam. In addition, an electrostatic capacitance between the gate electrode 103 and other electrodes is doubled, so that a high speed modulation of the electron beam becomes difficult.

Furthermore, Japanese Patent Application Laid-open Publication No. JP-A-6-111737 has proposed a flat display panel structure as shown in FIG. 3A, in which a spread suppressing electrode 113 is provided to suppress the spreading of the electrons, in order to prevent the electron from reaching an adjacent pixel, as shown in FIG. 3B. In FIGS. 3A and 3B, elements similar to those shown in FIG. 1 are given the same Reference Numerals, 114 is phosphor, 115 is an anode and 116 is an opposing plate, and explanation thereof will be omitted for simplification of the description.

However, this makes the panel structure complicated, and increases the number of steps required in a manufacturing process. In addition, since it is necessary to apply an adjustable voltage to the spread suppressing electrode 113, an external circuit and a connection to the external circuit inevitably become complicated.

Japanese Patent Application Laid-open Publication No. JP-A-6-084453, which corresponds to U.S. Pat. No. 5,278,472, has proposed to form on the same substrate a plurality of micro cold cathodes which have different gate opening diameters but emitters of the same height, as shown in FIG. 4, in which, elements similar to those shown in FIG. 1 are given the same Reference Numerals, and explanation thereof will be omitted for simplification of the description. In this proposal, since formation of the emitters by evaporation is divided into two steps, the emitters are formed to have the same height, irrespectively of the gate opening diameters.

In addition, Japanese Patent Application Laid-open Publication No. JP-A-64-054637 (namely, JP-A-1-054637) has proposed to form on the same substrate a plurality of micro cold cathodes which have different insulator layer thicknesses and different emitter heights, as shown in FIG. 5. In FIG. 5, elements similar to those shown in FIG. 1 are given the same Reference Numerals, and explanation thereof will be omitted for simplification of the description. This structure is intended to realize a large current change with a small voltage change, by combining currents of different voltage-current characteristics, for the purpose of realizing a cathode having a sharp rising characteristic and an excellent response property.

However, these two proposals are intended to realize special electron emission characteristics, but cannot suppress a lateral velocity component of the electron beam, nor can they minimize the diameter of the electron beam spot.

SUMMARY OF THE INVENTION

Accordingly, it is an object of the present invention to provide a field emission cold cathode composed of micro cathodes, which have overcome the above mentioned defects of the conventional ones.

Another object of the present invention is to provide a field emission cold cathode composed of micro electrodes, in which the lateral velocity component of electrons emitted from micro cathodes in a peripheral electron emission zone is effectively minimized, so as to maintain a divergent angle of an electron travelling path at a small value, resulting in formation of an electron beam having a small spread.

The above and other objects of the present invention are achieved in accordance with the present invention by a field emission cold cathode composed of a plurality of micro cold cathodes, the field emission cold cathode comprising a substrate, a plurality of electron emission electrodes formed in an electron emission zone defined on the substrate and each having a sharp tip end, an insulator layer formed on the substrate to surround each of the plurality of electron emission electrodes, and a control electrode formed on the insulator layer to have a plurality of openings, each of the openings surrounding a corresponding one of the plurality of electron emission electrodes, so that each one of the micro cold cathodes is constituted of one of the plurality of electron emission electrodes and a corresponding one of the plurality of openings formed in the control electrode, wherein the improvement is that the plurality of micro cold cathodes are so configured that the electrons emitted from a peripheral region of the electron emission zone have a lateral velocity component smaller than that of the electrons emitted from a central region of the electron emission zone.

For this purpose, the diameter of the plurality of openings formed in the control electrode is made large at the central region of the electron emission zone but small at the peripheral region Of the electron emission zone, or the thickness of the control electrode is made small at the central region of the electron emission zone but large at the peripheral region of the electron emission zone, or alternatively, the thickness of the insulator layer is made small at the central region of the electron emission zone but large at the peripheral region of the electron emission zone.

Alternatively, a resistance layer is provided between the substrate and the plurality of electron emission electrodes, and resistivity of the resistance layer is small at the central region of the electron emission zone but large at the peripheral region of the electron emission zone.

With the above mentioned structure of the field emission cold cathode, it is possible to minimize the lateral velocity component of the electrons emitted from the peripheral region of the electron emission zone, so as to maintain the divergent angle of the electron travelling path at a small value, with giving no large adverse influence to the electron emission characteristics of the field emission cold cathode.

The above mentioned field emission cold cathode can be used as an electron emission source in a display apparatus including the electron emission source and a phosphor layer in a vacuum envelop.

For example, when the above mentioned field emission cold cathode is used in a cathode ray tube, it is possible to make the electron beam spot size on the screen small, so that a high resolution of image can be realized.

If the above mentioned field emission cold cathode is used in a flat display panel, a similar high resolution of image can be realized, and also, since a distance between the cathode and the phosphor plane can be made large, it is possible to apply a high acceleration voltage to the phosphor, so that a luminous efficiency can be elevated. Furthermore, since the amount of electrons that reach adjacent pixels is reduced, the contrast and the color purity can be improved.

The above and other objects, features and advantages of the present invention will be apparent from the following description of preferred embodiments of the invention with reference to the accompanying drawings.

DESCRIPTION OF THE PREFERRED EMBODIMENTS

Figure 1:
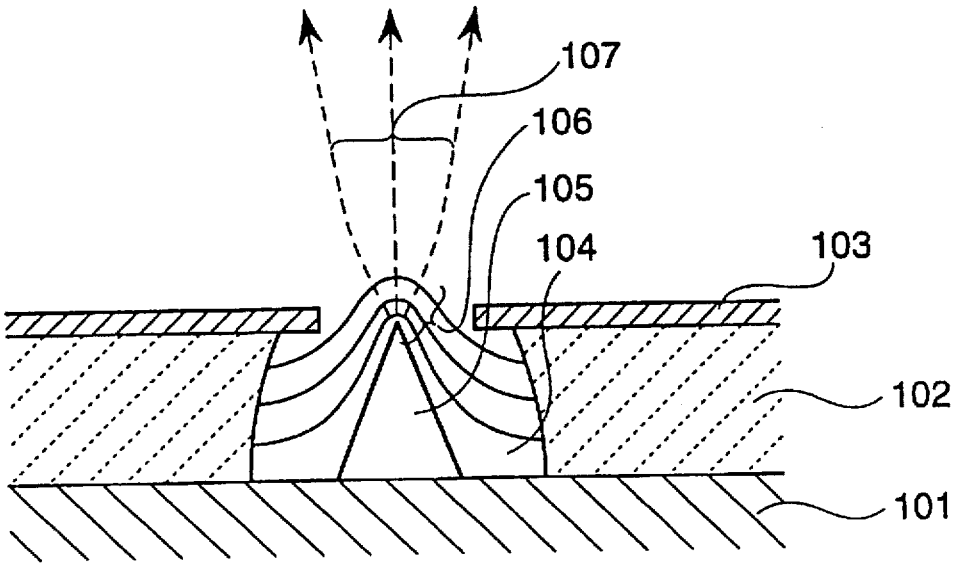
FIGURE 1 PRIOR ART
FIG. 1 is a diagrammatic sectional view of one micro cathode of a first example of the conventional field emission cold cathode.
Figure 2:
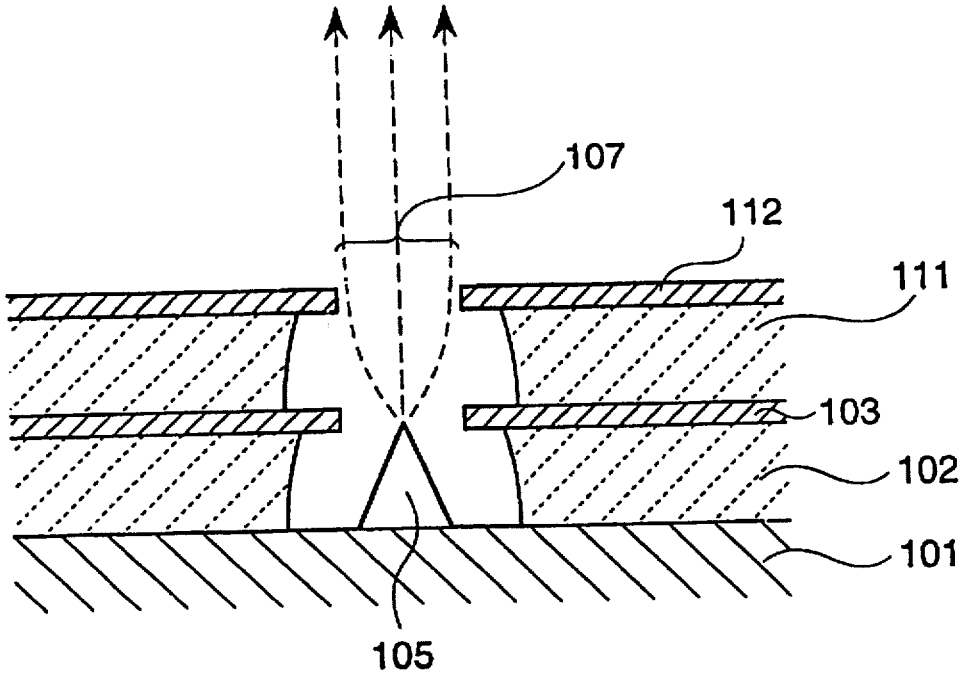
FIGURE 2 PRIOR ART
FIG. 2 is a diagrammatic sectional view of one micro cathode of a second example of the conventional field emission cold cathode.
Figure 3A:
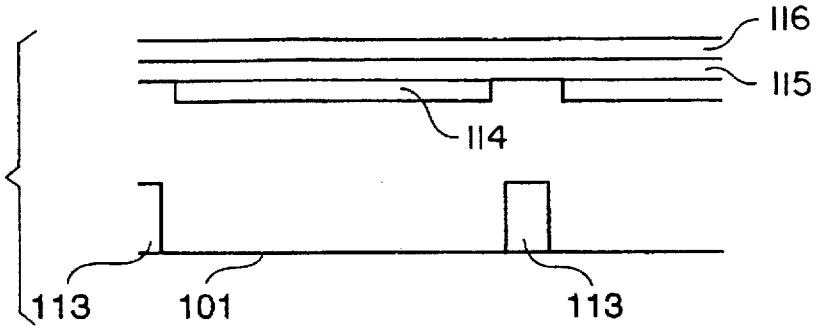
FIGURE 3A PRIOR ART
FIG. 3A is a diagrammatic sectional view illustrating a spread suppressing electrode in a third example of the conventional field emission cold cathode.
Figure 3B:
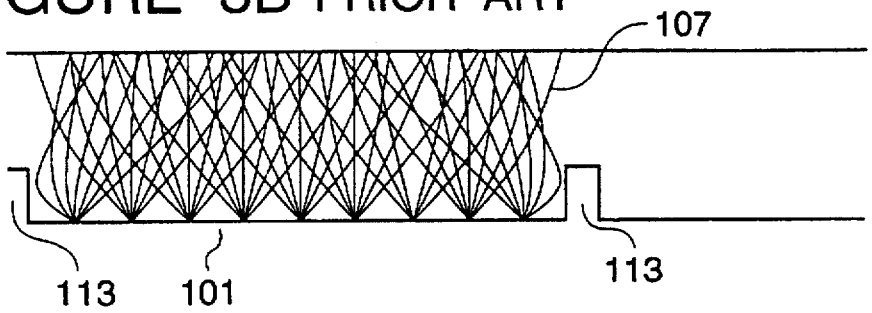
FIGURE 3B PRIOR ART
FIG. 3B illustrates an electric field divergence in the field emission cold cathode shown in FIG. 3A.
Figure 4:
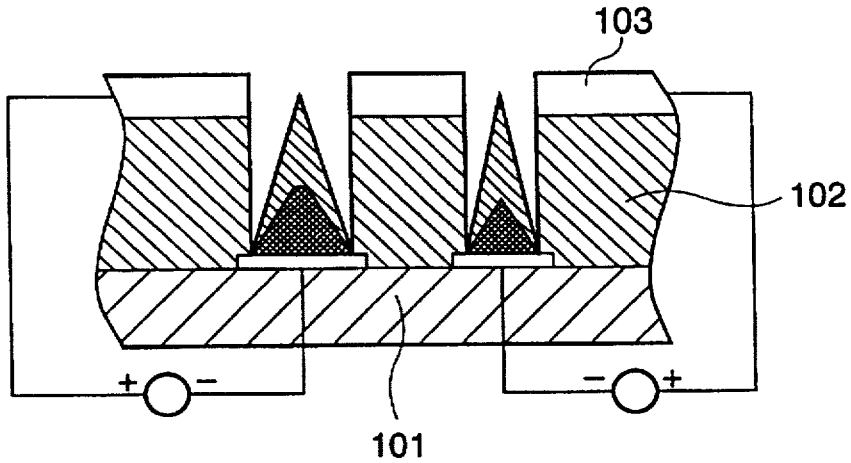
FIGURE 4 PRIOR ART
FIG. 4 is a partial diagrammatic sectional view of a fourth example of the conventional field emission cold cathode.
Figure 5:
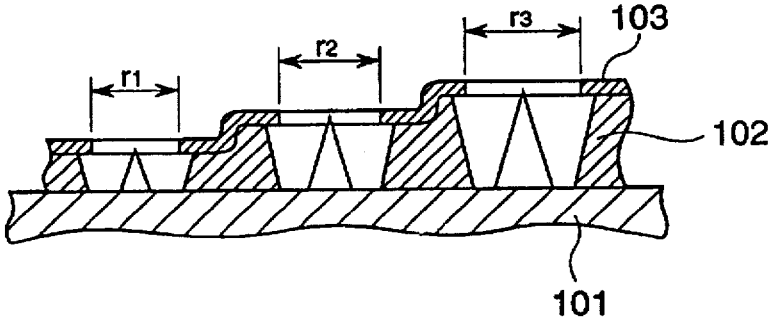
FIGURE 5 PRIOR ART
FIG. 5 is a partial diagrammatic sectional view of a fifth example of the conventional field emission cold cathode.
Figure 6:
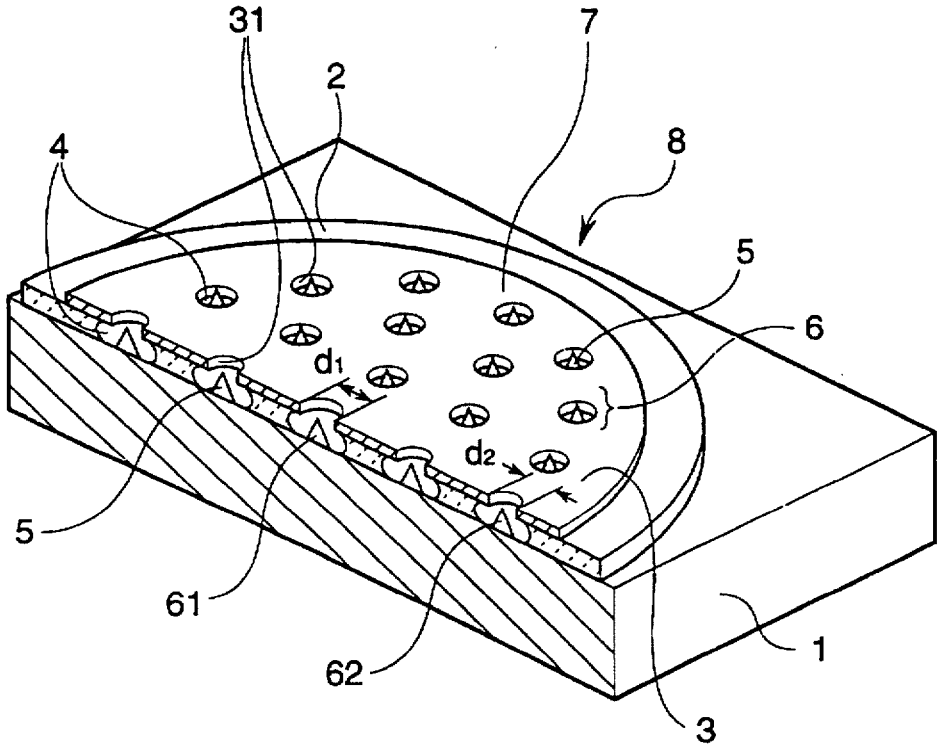
FIG. 6 is a diagrammatic perspective view, cut along a center transverse line, of a first embodiment of the field emission cold cathode in accordance with the present invention.

Referring to FIG. 6, there is shown a diagrammatic perspective view, cut along a center transverse line, of a first embodiment of the field emission cold cathode in accordance with the present invention.

In FIG. 6, a field emission cold cathode is generally designated by Reference Numeral 8, and includes a silicon substrate 1, on which an insulator layer 2 and a gate electrode 3 are formed in the named order. In addition, a number of micro cavities 4 are formed in a stacked structure of the insulator layer 2 and the gate electrode 3, so that a random or regular array is constituted of a number of micro cavities 4. Therefore, the gate electrode 3 includes a corresponding number of openings 31, each of which is in alignment with a corresponding micro cavity. In each of the micro cavities 4, a conical emitter 5 is formed, which is shaped to have a sharp tip end for emitting electrons. The emitter 5 is electrically connected to the substrate 1. Thus, one micro cathode 6 is constituted of one cavity 4, one emitter 5 located in the one cavity 4, and an opening 31 of the gate electrode 3 in alignment with the one cavity 4. A number of micro cathodes 6 constitute an electron emission zone 7. In other words, a number of micro cold cathodes 6 are formed within the electron emission zone 7 defined on the substrate 1.

For example, the emitter 5 is formed of a refractory metal such as tungsten or molybdenum, and the gate electrode 3 is also formed of a refractory metal such as tungsten, molybdenum, or niobium, or a refractory metal silicide such as tungsten silicide. The insulator layer 2 is formed for example of a thermally oxidized film of silicon ($SiO_2$).

In addition, the insulator layer 2 has a thickness of about 0.8 μm, and the gate electrode 3 has a thickness of about 0.2 μm. In a micro cold cathode 61 formed at a central region of the electron emission zone 7, the opening 31 of the gate electrode 3 has a diameter "d1" of about 1 μm, and the emitter 5 has a height of about 1 μm. On the other hand, in a micro cold cathode 62 formed at a peripheral region of the electron emission zone 7, the opening 31 of the gate electrode 3 has a diameter "d2" of about 0.8 μm, and the emitter 5 has a height of about 0.8 μm.

This cold cathode can be manufactured by the process disclosed by Spindt in the document referred to hereinbefore. For example, after the cavities 4 are formed in the gate electrode 3 and the insulator layer 2, a sacrifice layer is deposited from an inclined direction while the wafer is rotated, and then, an emitter material is deposited from a direction normal to the wafer. If the diameter of the gate electrode opening at the peripheral region of the electron emission zone 7 is made slightly smaller than a mask for forming the cavities 4, namely, than the diameter of the gate electrode opening at the central region of the electron emission zone 7, the emitters formed in the peripheral region of the electron emission zone 7 can be formed to have the height lower than that of the emitters formed in the other region of the electron emission zone 7.

In operation, assuming that the substrate is at a reference potential, a few 10 V to about 100 V is applied to the gate electrode 3. According to a simulation, if the peripheral region is compared with the central region, an influence due to the fact that the emitter height in the peripheral region is lower than that in the central region, appears more remarkably than an influence due to the fact that the gate electrode opening diameter in the peripheral region is smaller than that in the central region, with the result that the emission current of each one micro cold cathode in the peripheral region lowers in comparison with the emission current of each one micro cold cathode in the other region of the electron emission zone. However, the lateral velocity component of the traveling path of the electrons emitted from the micro cold cathodes in the peripheral region, becomes small, and therefore, a divergent angle of the electron traveling path becomes small.

Figure 7:
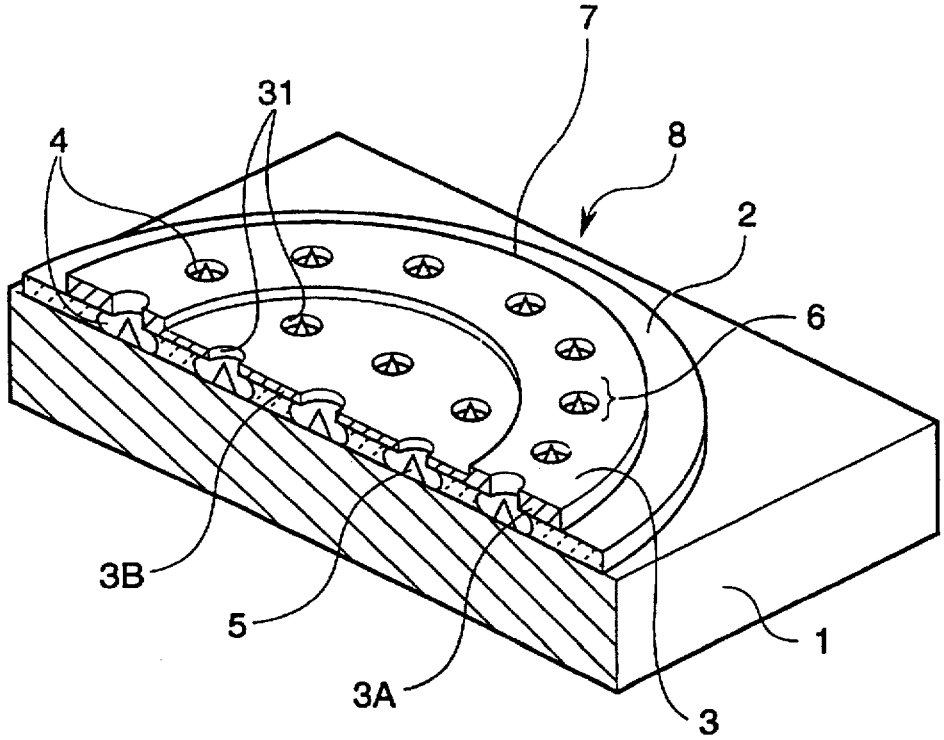
FIG. 7 is a diagrammatic perspective view, cut along a center transverse line, of a second embodiment of the field emission cold cathode in accordance with the present invention.

Referring to FIG. 7, there is shown a diagrammatic perspective view, cut along a center transverse line, of a second embodiment of the field emission cold cathode in accordance with the present invention. In FIG. 7, elements similar to those shown in FIG. 6 are given the same Reference Numerals, and explanation thereof will be omitted for simplification of the description.

The second embodiment is the same as the first embodiment, excepting that all of the gate electrode opening diameters are the same over the electron emission zone 7, but thee thickness of the gate electrode is different between the central region and the peripheral region of the electron emission zone 7. Specifically, the thickness of a gate electrode portion 3A in the peripheral region Of the electron emission zone 7 is larger than the thickness of a gate electrode portion 3B in the other region of the electron emission zone 7 including a central region of the electron emission zone 7.

In order to fabricate the gate electrode of the second embodiment, the insulator layer 2 having a uniform thickness and formed of a silicon oxide or a silicon nitride, is deposited on the substrate 1, and then, a metal layer having a uniform thickness is deposited on the insulator layer 2. Thereafter, a sacrifice layer is deposited, and then, patterned, and furthermore, a metal layer is deposited on only a peripheral region of the cathode, by using the patterned sacrifice layer as a mask. Then, unnecessary portion of the secondly deposited metal layer is removed. However, it would be apparent to persons skilled in the art that the gate electrode of the second embodiment can be formed by other various processes.

In this second embodiment, according to an simulation, the amount of current emitted from the peripheral region becomes small to some degree, but the lateral velocity component of the traveling path of the electrons emitted from the micro cold cathodes in the peripheral region, becomes small, similarly to the first embodiment, and therefore, a divergent angle of the electron traveling path becomes small.

If the diameter of all the gate electrode openings distributed over the whole surface of the cold cathode 8 is made small, the height of the emitters formed by evaporation becomes small, and therefore, it is possible to reduce the divergent angle of the electron beam emitted from all the emitters distributed over the whole surface of the cold cathode. However, at the same time, the emission current drops under the same emitter-gate voltage, so that the electron emission characteristics correspondingly drops. If the gate voltage is elevated to obtain the same emission current, the lateral velocity component simultaneously increases, and therefore, the expected effect of suppressing the lateral velocity component cannot be obtained. However, the divergent angle of the electron flow emitted from the emitters in the central region of the electron emission zone does not give a large influence on the spreading of the electron beam generated from the whole surface of the cold cathode 8. Therefore, by suppressing only the divergent angle of the electron flow emitted from the emitters in the peripheral region of the electron emission zone, it is possible to effectively suppress only the spreading of the electron beam with no remarkable drop of the emission characteristics.

Figure 8:
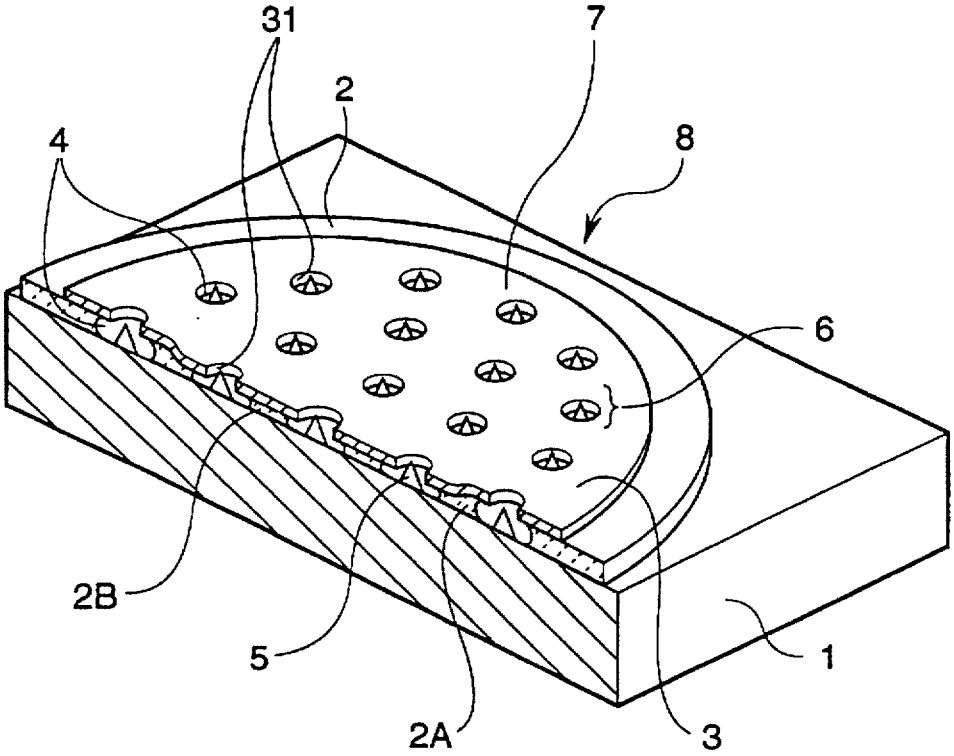
FIG. 8 is a diagrammatic perspective view, cut along a center transverse line, of a third embodiment of the field emission cold cathode in accordance with the present invention.

Referring to FIG. 8, there is shown a diagrammatic perspective view, cut along a center transverse line, of a third embodiment of the field emission cold cathode in accordance with the present invention. In FIG. 8, elements similar to those shown in FIG. 6 are given the same Reference Numerals, and explanation thereof will be omitted for simplification of the description.

The third embodiment is the same as the first embodiment, excepting that the gate electrode thickness is the same over the electron emission zone 7 and all of the gate electrode opening diameters are the same over the electron emission zone 7, but the thickness of the insulator layer is different between the central region and the peripheral region of the electron emission zone 7. Specifically, the thickness of an insulator layer portion 2A in the peripheral region of the electron emission zone 7 is larger than the thickness of an insulator layer portion 2B in the other region of the electron emission zone 7.

In order to fabricate the insulator layer of the third embodiment, the insulator layer 2 having a uniform thickness and formed of a silicon oxide or a silicon nitride, is deposited on the substrate 1, and then, a sacrifice layer is deposited, and then, patterned, and furthermore, a silicon oxide or a silicon nitride is deposited on only a peripheral region of the cathode, by using the patterned sacrifice layer as a mask. Then, unnecessary portion of the secondly deposited silicon oxide or silicon nitride layer is removed. Thereafter, a metal layer having a uniform thickness is deposited on the insulator layer 2. However, it would be apparent to persons skilled in the art that the insulator layer of the third embodiment can be formed by other various processes.

In this third embodiment, according to an simulation, the amount of current emitted from the peripheral region becomes small to some degree, but the lateral velocity component of the traveling path of the electrons emitted from the micro cold cathodes in the peripheral region, becomes small, similarly to the first embodiment, and therefore, a divergent angle of the electron traveling path becomes small.

Figure 9:
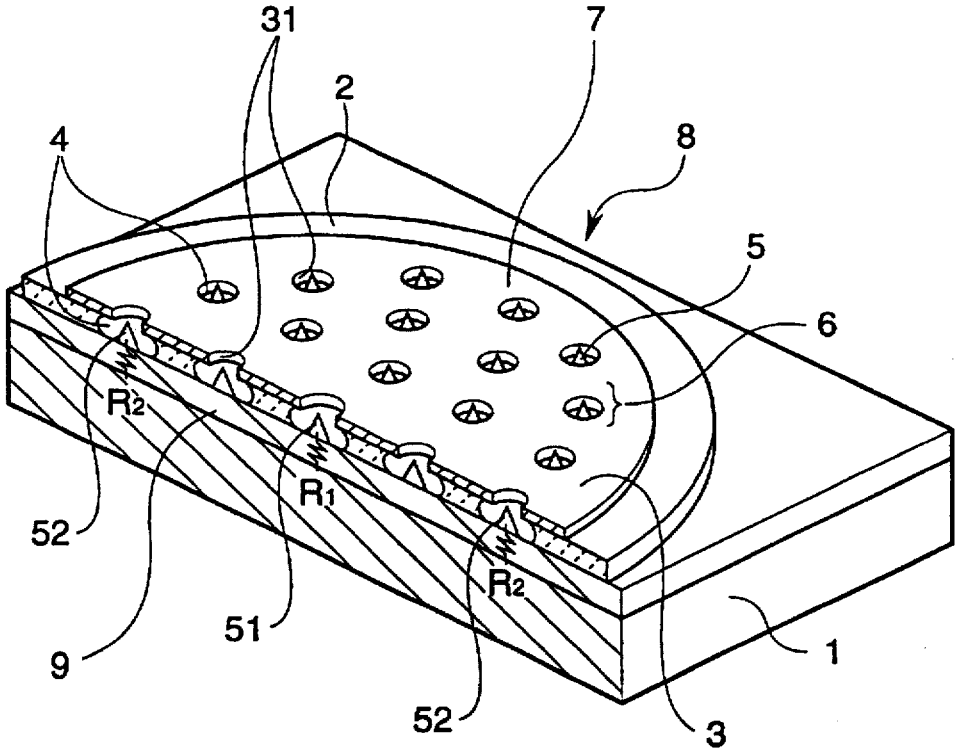
FIG. 9 is a diagrammatic perspective view, cut along a center transverse line, of a fourth embodiment of the field emission cold cathode in accordance with the present invention.

Referring to FIG. 9, there is shown a diagrammatic perspective view, cut along a center transverse line, of a fourth embodiment of the field emission cold cathode in accordance with the present invention. In FIG. 9, elements similar to those shown in FIG. 6 are given the same Reference Numerals, and explanation thereof will be omitted for simplification of the description.

The fourth embodiment is the same as the first embodiment, excepting that all of the gate electrode opening diameters are the same over the electron emission zone 7, but a resistance layer 9 is deposited on the substrate 1, and the insulator layer 2 and the emitters 5 are formed on the resistance layer 9. This resistance layer 9 gives a resistance of about 1MΩ to 10MΩ in series with each one emitter 5, so that there occurs a voltage drop in proportion to the emission current.

In this fourth embodiment, the thickness of the gate electrode 3, the thickness of the insulator layer 2 and the diameter of the openings 3A in the gate electrode are uniform over the whole of the electron emission zone, but the resistance layer 9 is so configured that a series resistance R2 connected to the emitters 52 in the peripheral region is slightly larger than a series resistance R1 connected to the emitter 51 in the central region.

In order to form the above mentioned resistance layer 9, for example, a silicon epitaxial layer is formed on the silicon substrate 1 as the resistance layer 9, and a mask is formed to protect a peripheral portion of the silicon epitaxial layer, and then, impurities are ion-implanted through the mask thus formed, so that a sheet resistance of the resistance layer 9 lowers in the central region of the cold cathode 8. Namely, the sheet resistance becomes different between the central region and the peripheral region of the cold cathode 8.

In this fourth embodiment, since the shape of the micro cold cathodes in the central region and the peripheral region are the same, the travelling path of the electrons emitted from the micro cold cathodes is similar. However, since the voltage drop of the emission current is different between the electrons emitted from the micro cold cathodes in the central region and the electrons emitted from the micro cold cathodes in the peripheral region, the emitter-gate voltage are different between the central region and the peripheral region. Therefore, the absolute value of the initial velocity of the electrons emitted from the emitters in the peripheral region becomes small, and accordingly, the lateral velocity component correspondingly becomes small.

The first to fourth embodiments can be used singly, but if any two, three or all of the first to fourth embodiments can combined, a further enhanced advantage can be obtained.

Figure 10:
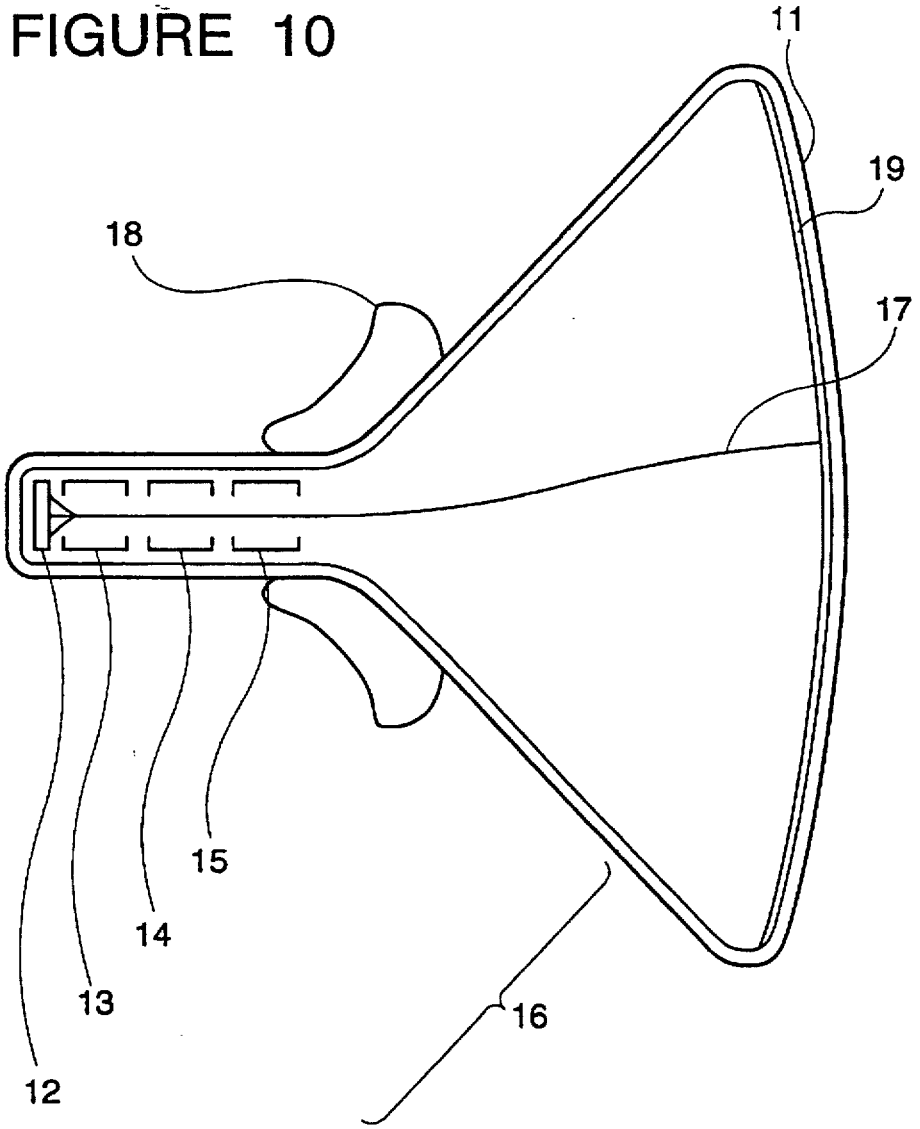
FIG. 10 is a diagrammatic sectional view of a cathode ray tube, which can be applied with the field emission cold cathode in accordance with the present invention.

Referring to FIG. 10, there is shown a diagrammatic sectional view of a cathode ray tube, which can be applied with the field emission cold cathode in accordance with the present invention.

The shown cathode ray tube includes a vacuum glass envelop 11, and an electron gun 16 accommodated in a neck portion of the glass envelop 11. The electron gun 16 includes a cold cathode 12, a first focusing electrode 13, a second focusing electrode 14 and a third focusing electrode 15, as well known to persons skilled in the art. Thus, electrons emitted from the cold cathode 12 is focused and accelerated so as to form an electron beam 17, which is deflected by a deflection yoke 18 surrounding a base portion of the neck, in accordance with a current waveform applied to the yoke, so that the electron beam 17 bombards a phosphor layer 19 formed in an inner surface of a face place of the envelop 11.

Figure 11:
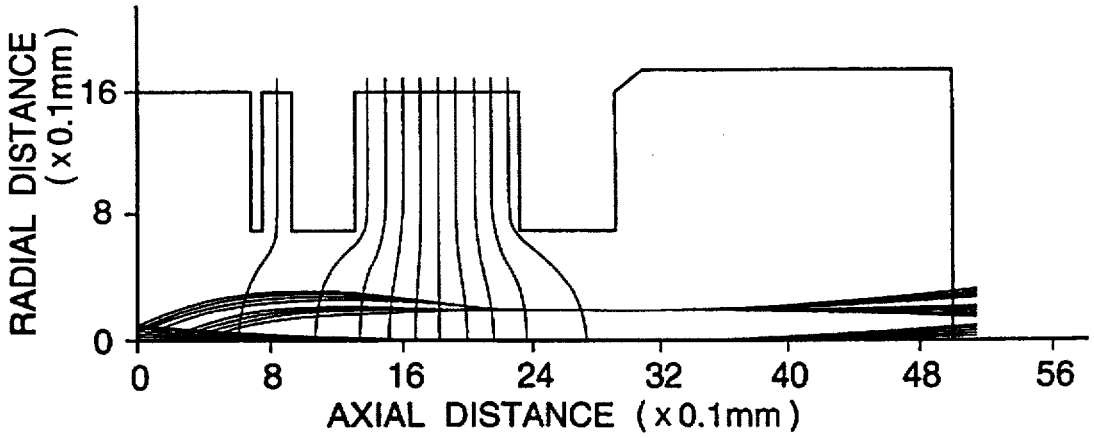
FIG. 11 illustrates an electron traveling path in the cathode ray tube.

FIG. 11 illustrates the travelling path of the electrons in the cathode ray tube, obtained according to a simulation. This simulation is based on the condition that the gate voltage is a reference potential, the emitter voltage is −100 V, the first focusing electrode voltage is 100 V, the second focusing electrode voltage is 500 V, the third focusing electrode voltage is 8 KV, and the divergent angle of the electrons at the cathode is 30 degrees. The electrons having a lateral velocity component will enlarge the spot of the electron beam on the phosphor layer 19, but in the case that the lateral velocity component of the electrons emitted from the peripheral region of the cold cathode is small, the spot enlarging effect is suppressed. Therefore, a high resolution of image can be obtained.

Figure 12:
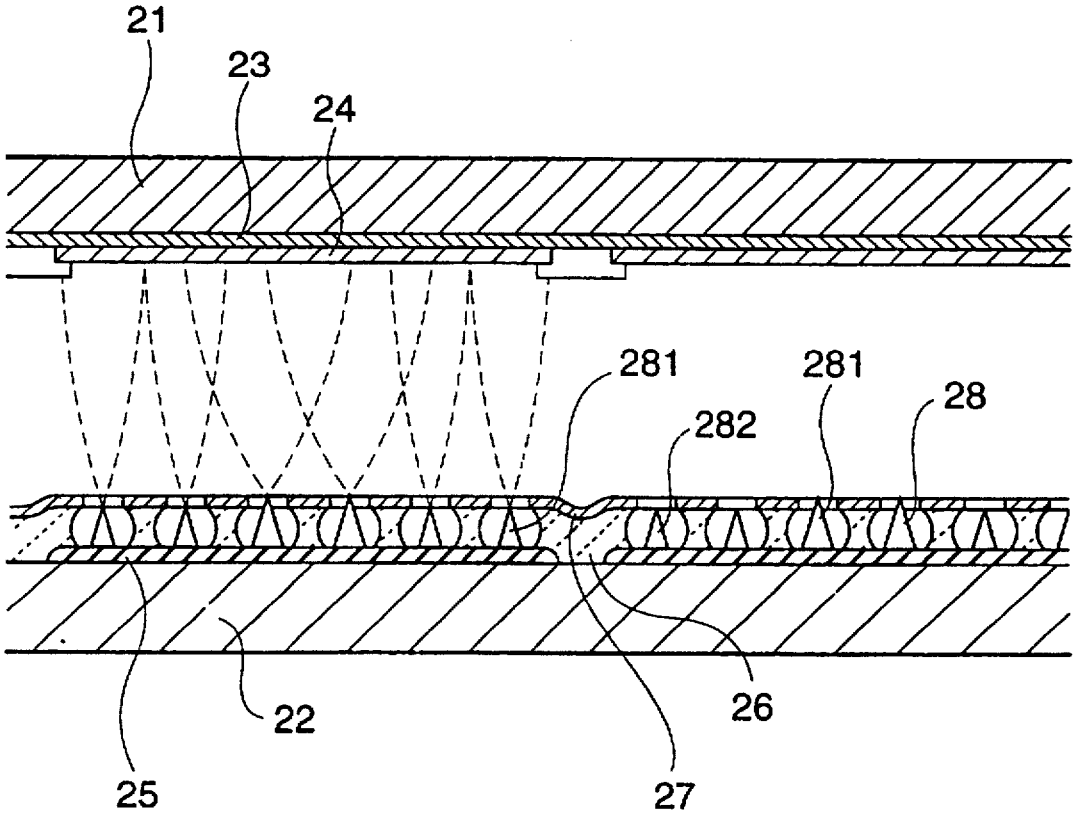
FIG. 12 is a diagrammatic sectional view of a flat display panel, which can be applied with the field emission cold cathode in accordance with the present invention.

Referring to FIG. 12, there is shown a diagrammatic sectional view of a flat display panel, which can be applied with the field emission cold cathode in accordance with the present invention.

In FIG. 12, a front glass 21 and a back glass 22 are located to oppose to each other, separately from each other, so as to form a vacuum envelop having a narrow gap of 100 μm or less between the front glass 21 and the back glass 22. On an inner surface (vacuum side) of the front glass 21, a transparent and conductive metal film such as ITO film 23 and a phosphor layer 24 are deposited in the named order. By applying an acceleration voltage of 200 V to 1000 V to the ITO film 24, electron beams are bombarded to the phosphor 24.

On an inner surface (vacuum side) of the back glass 22, an emitter electrode 25, an insulator layer 26 and a gate electrode 27 are formed in the named order. Cavities are formed in the insulator layer 26 and the gate electrode 27, and a conical emitter 28 is formed on the emitter electrode 25 within each of the cavities. Of a number of micro cold cathodes which constitute each one pixel, the gate opening diameter of micro cold cathodes is large in a central region but small in a peripheral region.

With this arrangement, the traveling path of the electrons emitted from the emitters 281 in the central region is divergent, but the traveling path of the electrons emitted from the emitters 282 in the peripheral region has a reduced divergent angle, so that possibility that some of the electrons emitted from all the micro cold cathodes of each one pixel bombards the phosphor for an adjacent pixel, is made extremely small.

Accordingly, a high resolution of image can be obtained. In addition, since it is possible to increase the distance between the cathode and the phosphor plane, it becomes possible to apply a high acceleration voltage, so that luminous efficiency can be elevated. Furthermore, since the electrons bombarding the phosphor for an adjacent pixel is minimized, the contrast and the color purity can be improved.

In the example shown in FIG. 12, the electron source is formed of the cold cathode of the first embodiment. However, the electron source can be formed of any one of the second to fourth embodiments, or can also be formed of a combination of any two, three or all of the first to fourth embodiments. In these modifications, a similar or further elevated advantage can be obtained.

The invention has thus been shown and described with reference to the specific embodiments. However, it should be noted that the present invention is in no way limited to the details of the illustrated structures but changes and modifications may be made within the scope of the appended claims.

We claim:

1. A field emission cold cathode composed of a plurality of micro cold cathodes, said field emission cold cathode comprising a substrate, a plurality of electron emission electrodes each having a sharp tip end and being formed in an electron emission zone defined on said substrate, an insulator layer formed on said substrate to surround each of said plurality of electron emission electrodes, and a control electrode formed on said insulator layer to have a plurality of openings, each of said openings surrounding a corresponding one of said plurality of electron emission electrodes so that each one of said micro cold cathodes includes one of said plurality of electron emission electrodes and a corresponding one of said plurality of openings formed in said control electrode, wherein the improvement is that said plurality of micro cold cathodes are configured so that the electrons emitted from a peripheral region of said electron emission zone have a lateral velocity component smaller than that of the electrons emitted from a central region of said electron emission zone.

2. A field emission cold cathode claimed in claim 1 wherein the diameter of said plurality of openings formed in said control electrode is large at said central region of said electron emission zone but small at said peripheral region of said electron emission zone.

3. A field emission cold cathode claimed in claim 2 wherein the thickness of said control electrode is small at said central region of said electron emission zone but large at said peripheral region of said electron emission zone.

4. A field emission cold cathode claimed in claim 3 wherein the thickness of said insulator layer is small at said central region of said electron emission zone but large at said peripheral region of said electron emission zone.

5. A field emission cold cathode claimed in claim 4 wherein a resistance layer is provided between said substrate and said plurality of electron emission electrodes, and resistivity of said resistance layer is small at said central region of said electron emission zone but large at said peripheral region of said electron emission zone.

6. A field emission cold cathode claimed in claim 1 wherein the thickness of said control electrode is small at said central region of said electron emission zone but large at said peripheral region of said electron emission zone.

7. A field emission cold cathode claimed in claim 6 wherein the thickness of said insulator layer is small at said central region of said electron emission zone but large at said peripheral region of said electron emission zone.

8. A field emission cold cathode claimed in claim 7 wherein a resistance layer is provided between said substrate and said plurality of electron emission electrodes, and resistivity of said resistance layer is small at said central region of said electron emission zone but large at said peripheral region of said electron emission zone.

9. A field emission cold cathode claimed in claim 1 wherein the thickness of said insulator layer is small at said central region of said electron emission zone but large at said peripheral region of said electron emission zone.

10. A field emission cold cathode claimed in claim 9 wherein a resistance layer is provided between said substrate and said plurality of electron emission electrodes, and resistivity of said resistance layer is small at said central region of said electron emission zone but large at said peripheral region of said electron emission zone.

11. A field emission cold cathode claimed in claim 1 wherein a resistance layer is provided between said substrate and said plurality of electron emission electrodes, and resistivity of said resistance layer is small at said central region of said electron emission zone but large at said peripheral region of said electron emission zone.

12. A cathode ray tube including a vacuum envelop having a neck and a face plate, a phosphor layer formed on an inside of said face plate, an electron gun located in said neck to emit an electron beam toward said phosphor layer, and a deflection means located outside of said vacuum envelop so as to deflect said electron beam emitted from said electron gun, said electron gun including a field emission cold cathode composed of a plurality of micro cold cathodes, said field emission cold cathode comprising a substrate, a plurality of electron emission electrodes each having a sharp tip end and being formed in an electron emission zone defined on said substrate, an insulator layer formed on said substrate to surround each of said plurality of electron emission electrodes, and a control electrode formed on said insulator layer to have a plurality of openings, each of said openings surrounding a corresponding one of said plurality of electron emission electrodes so that each one of said micro cold cathodes includes one of said plurality of electron emission electrodes and a corresponding one of said plurality of openings formed in said control electrode, wherein the improvement is that said plurality of micro cold cathodes are configured so that the electrons emitted from a peripheral region of said electron emission zone have a lateral velocity component smaller than that of the electrons emitted from a central region of said electron emission zone.

13. A cathode ray tube claimed in claim 12 wherein the diameter of said plurality of openings formed in said control electrode is large at said central region of said electron emission zone but small at said peripheral region of said electron emission zone.

14. A field emission cold cathode claimed in claim 12 wherein the thickness of said control electrode is small at said central region of said electron emission zone but large at said peripheral region of said electron emission zone.

15. A field emission cold cathode claimed in claim 12 wherein the thickness of said insulator layer is small at said central region of said electron emission zone but large at said peripheral region of said electron emission zone.

16. A field emission cold cathode claimed in claim 12 wherein a resistance layer is provided between said substrate and said plurality of electron emission electrodes, and resistivity of said resistance layer is small at said central region of said electron emission zone but large at said peripheral region of said electron emission zone.

17. A flat panel display including a front plate and a back plate assembled to form a vacuum envelop, a phosphor layer provided on an inside of the front plate and divided into a plurality of pixels, and a plurality of electron emission sources provided on an inside of the back plate, each of said electron emission sources being located to emit an electron beam toward said phosphor layer of a corresponding pixel, each of said electron emission sources being composed of a field emission cold cathode composed of a plurality of micro cold cathodes, said field emission cold cathode comprising a substrate, a plurality of electron emission electrodes each having a sharp tip end and being formed in an electron emission zone defined on said substrate, an insulator layer formed on said substrate to surround each of said plurality of electron emission electrodes, and a control electrode formed on said insulator layer to have a plurality of openings, each of said openings surrounding a corresponding one of said plurality of electron emission electrodes so that each one of said micro cold cathodes includes one of said plurality of electron emission electrodes and a corresponding one of said plurality of openings formed in said control electrode, wherein the improvement is that said plurality of micro cold cathodes are configured so that the electrons emitted from a peripheral region of said electron emission zone have a lateral velocity component smaller than that of the electrons emitted from a central region of said electron emission zone.

18. A cathode ray tube claimed in claim 17 wherein the diameter of said plurality of openings formed in said control electrode is large at said central region of said electron emission zone but small at said peripheral region of said electron emission zone.

19. A field emission cold cathode claimed in claim 17 wherein the thickness of said control electrode is small at said central region of said electron emission zone but large at said peripheral region of said electron emission zone.

20. A field emission cold cathode claimed in claim 17 wherein the thickness of said insulator layer is small at said central region of said electron emission zone but large at said peripheral region of said electron emission zone.

21. A field emission cold cathode claimed in claim 17 wherein a resistance layer is provided between said substrate and said plurality of electron emission electrodes, and resistivity of said resistance layer is small at said central region of said electron emission zone but large at said peripheral region of said electron emission zone.

* * * * *